United States Patent [19]

Bryans

[11] Patent Number: 4,576,550

[45] Date of Patent: Mar. 18, 1986

[54] DIFFUSER FOR A CENTRIFUGAL COMPRESSOR

[75] Inventor: Alexander C. Bryans, Reading, Mass.

[73] Assignee: General Electric Company, Lynn, Mass.

[21] Appl. No.: 557,561

[22] Filed: Dec. 2, 1983

[51] Int. Cl.[4] ..... F04D 29/44

[52] U.S. Cl. ..... 415/211

[58] Field of Search ..... 415/181, 207, 210, 211, 415/DIG. 1

[56] References Cited

U.S. PATENT DOCUMENTS

| | | | |
|---|---|---|---|
| 3,333,762 | 8/1967 | Vrana | 415/207 |
| 3,719,430 | 3/1973 | Blair et al. | 415/207 |
| 3,743,436 | 7/1973 | O'Connor | 415/211 X |
| 3,860,360 | 1/1975 | Yu | 415/211 |
| 3,905,721 | 9/1975 | Fitzpatrick | 415/211 |
| 3,917,434 | 11/1975 | Bandukwalla | 415/181 |
| 3,930,746 | 1/1976 | Kronogard | 415/DIG. 1 X |
| 4,027,997 | 6/1977 | Bryans | 415/211 X |

FOREIGN PATENT DOCUMENTS

| | | | |
|---|---|---|---|
| 60898 | 5/1981 | Japan | 415/211 |

*Primary Examiner*—Robert E. Garrett
*Assistant Examiner*—Joseph M. Pitko
*Attorney, Agent, or Firm*—Francis L. Conte; Derek P. Lawrence

[57] ABSTRACT

The diffuser of the present invention comprises a plurality of passages which intersect at radially inner ends thereof to define a quasi-vaneless annular inlet for receiving accelerated gases from an impeller of a centrifugal compressor. Each of the passages includes a throat portion having a quadrilateral cross section, including two subtantially parallel linear sidewalls and two substantially arcuate opposing sidewalls, effective for reducing the length of and thereby pressure losses from the annular inlet. The linearity and regularity of the diffuser passages enables the diffuser to be manufactured to close tolerances by electric discharge milling an annular plate utilizing a single tool. This assures uniformity and consistency between diffusers.

20 Claims, 7 Drawing Figures

DIFFUSER FOR A CENTRIFUGAL COMPRESSOR

The U.S. government has rights in this invention pursuant to Contract No. DAAK51-83-C-0014 awarded by the Department of the Army.

BACKGROUND OF THE INVENTION

The invention relates to a diffuser and, more particularly, to a diffuser for a centrifugal compressor which is configured to optimize flow distribution to a combustion chamber and which may be manufactured to close tolerances in a manner which assures uniformity between diffusers.

A centrifugal compressor includes a rotating impeller arranged to accelerate and thereby increase the kinetic energy of a gas flowing therethrough. The diffuser is generally characterized by a quasi-vaneless annular space surrounding the impeller. The diffuser acts to decrease the velocity of the gas flow leaving the impeller to transform the energy thereof to an increase in static pressure, thus generating pressurized gas.

Prior art diffusers have generally included a plurality of circumferentially spaced passages which converge to the annular space surrounding the impeller. These passages expand in area downstream of the impeller in order to diffuse the flow exiting the impeller. It has been found for prior art diffusers of this type which are to be utilized with gas turbine engines that it is preferable to have the diffuser passages assume an initial circular cross section so as to accommodate with minimal losses the relatively high-flow velocities of the gases exiting the impeller and thereafter gradually merge into a near-rectangular outlet to minimize losses.

One diffuser of this type is disclosed in U.S. Pat. No. 4,027,997 issued to A. C. Bryans on June 7, 1977, and assigned to the assignee of this invention. The Bryans diffuser comprises a plurality of linear passages in flow communication with a quasi-vaneless annular inlet surrounding the impeller of a centrifugal compressor. Each passage gradually merges from a circular cross section at a throat portion near its inlet end, to a near rectangular cross section at its outlet end defined by two flat opposing parallel sides and two flat opposing curved sides which produce a razor sharp trailing edge at the diffuser outlet. This near rectangular shape of the diffuser outlet optimizes the flow distribution to an annular combustion chamber in flow communication with the diffuser outlet.

Diffusers constructed in accordance with the teachings of the Bryans patent have demonstrated significant improvements in the performance of centrifugal compressors for gas turbine engines. However, inasmuch as the quasi-vaneless inlet of the diffuser receives accelerated gases directly from the impeller, it is subjet to relatively high viscous drag which results in undesirable pressure losses.

Accordingly, it is an object of the present invention to provide a new and improved diffuser for a centrifugal compressor.

Another object of the present invention is to provide a diffuser wherein the length of the quasi-vaneless inlet is reduced for reducing the total of viscous drag thereover.

Another object of the present invention is to provide a diffuser for a centrifugal compressor which is configured to optimize flow distribution to a combustion chamber and which may be easily manufactured to close tolerances in a manner which assures uniform between diffusers.

SUMMARY OF THE INVENTION

The diffuser of the present invention comprise plurality of passages which intersect at radially in ends thereof to define a quasi-vaneless annular inlet receiving accelerated gases from an impeller of a c trifugal compressor. Each of the passages include throat portion having a quadrilateral cross section, cluding two substantially parallel linear sidewalls a two substantially arcuate opposing sidewalls, effect for reducing the length of and thereby pressure los from the annular inlet. The linearity and regularity the diffuser passages enables the diffuser to be manuf tured to close tolerances by electric discharge milli an annular plate utilizing a single tool. This assu uniformity and consistency between diffusers.

BRIEF DESCRIPTION OF THE DRAWINGS

The novel features believed characteristic of the vention are set forth in the appended claims. The inv tion itself, together with further objects and advanta thereof, is more particularly described in the followi detailed description taken in conjunction with the companying drawings in which:

DETAILED DESCRIPTION

Figure 1:
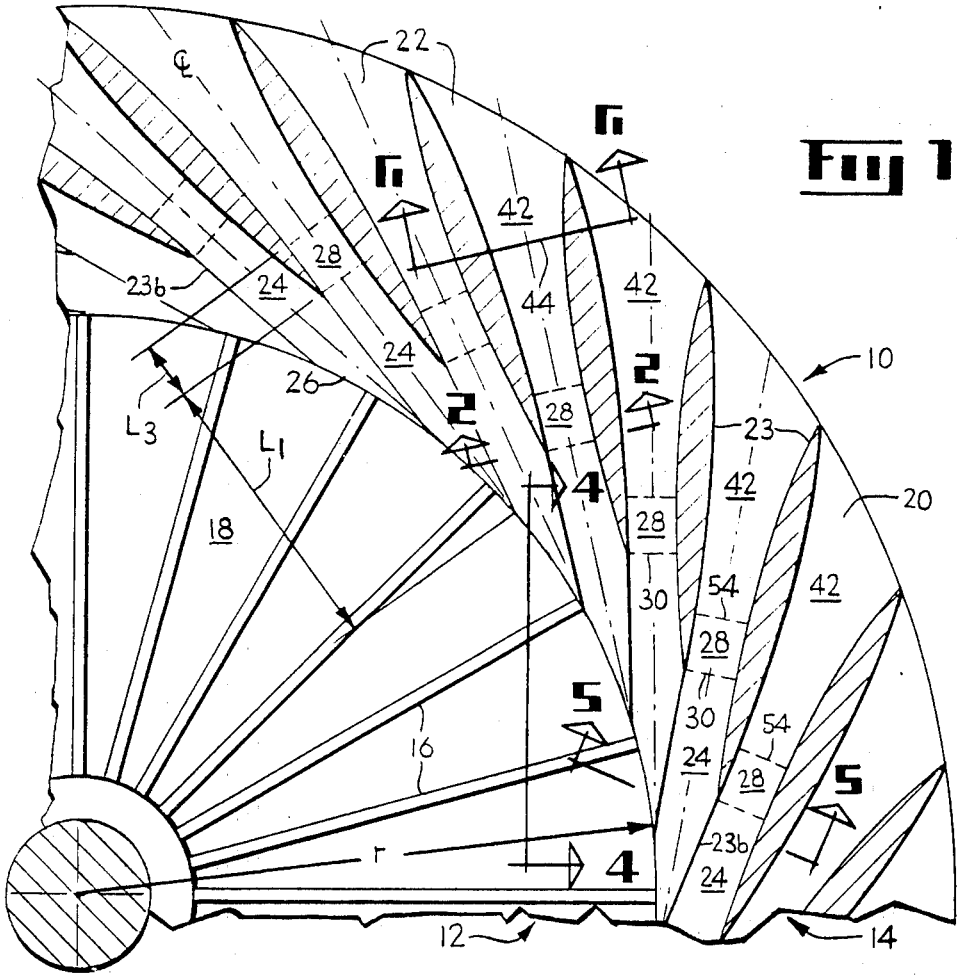
FIG. 1 is a fragmentary sectional view of a compr sor including a diffuser in accordance with the pres invention.

Illustrated in FIG. 1 is a fragmentary sectional vi of a centrifugal compressor 10 which is effective pressuring air to a combustion chamber of a conve tional gas turbine engine (not shown). The compress 10 includes an annular impeller 12 in flow communi tion with an improved annular diffuser 14 according one embodiment of the present invention disposed ra ally outwardly thereof. Centrifugal compressors well known in the art for converting the relatively hi kinetic energy of gases accelerated by the rotating i peller 12 into static-pressure energy. The diffuser according to the present invention, however, represe an improvement over conventional diffusers, and, particular, over the above-described diffuser disclos in U.S. Pat. No. 4,027,997—A. C. Bryans, incorporat herein by reference.

The conventional impeller 12 includes a plurality circumferentially spaced impeller blades 16 support by an annular web 18. The diffuser 14 includes an an lar diffuser housing 20 having a plurality of tangentia disposed flow passages 22, which are disposed alo linear centerlines, spaced about the circumference the housing 20 and extending therethrough. The p sages 22 are partly defined and bounded by a plurality of spaced, generally convex vanes 23. Adjacent ones of the passages 22 intersect with each other at radially inner, inlet portions 24 that define a quasi-vaneless annular inlet 26 of the diffuser 14. Each passage 22 further includes a throat portion 28 which is integral with the inlet portion 24 and has a first quadrilateral cross section 30, which defines the flow passage thereof, including: two substantially parallel linear opposing sidewalls 32 and 34 and two substantially arcuate opposing sidewalls 36 and 38 (see FIG. 2).

Figure 5:
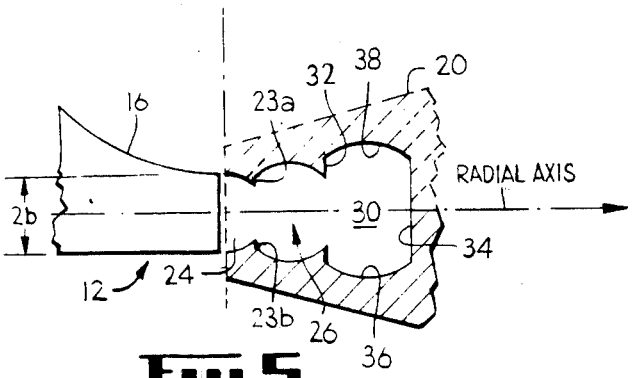
FIG. 5 is a sectional view taken along line 5—5 FIG. 1.
Figure 4:
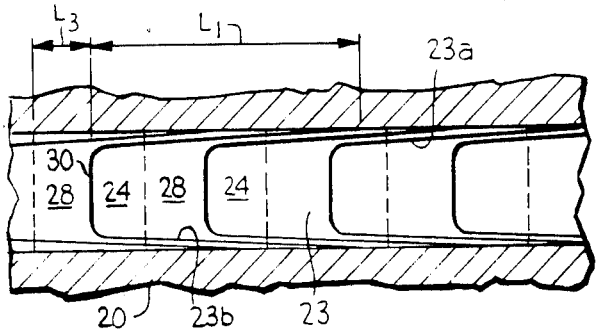
FIG. 4 is a sectional view taken along line 4—4 FIG. 1.

As illustrated in FIGS. 1, 4 and 5, the inlet portion 24 is a partially bounded passage having a generally semi-circular cross section, open at an apex thereof, at its upstream end which tapers to a generally flat, linear-sided section at its downstream end where it intersects the throat portion 28. The throat portion 28 represents the first fully bounded flow portion of the passage 22. The annular inlet 26 is defined as quasi-vaneless because the vanes 23 primarily end at the upstream end of the throat portion 28 with only relatively small lip or step portions 23*a* and 23*b* extending and tapering from the throat portion 28 to the upstrean end of the inlet portion 24.

A significant feature of the present invention is the introduction of the step portions 23*a* and 23*b* in the inlet portion 24, as illustrated in FIG. 5, which include flat, radially outwardly facing surfaces represented by portions of the sidewall 32 and arcuate, radially inwardly facing surfaces represented by portions of the sidewalls 36 and 38. The flat surfaces of step portions 23*a* and 23*b* act as walls to help confine airflow in the quasi-vaneless inlet 26 for reducing distortion thereof and the possibility of stall therein.

More specifically, it will be appreciated that pressure of the airflow in the inlet 26 increases in a radially outward direction. Higher pressure at radially outer portions will tend to cause the boundary layer found along the walls of the inlet 26 to be forced radially inwardly, which can possibly lead to stall. Accordingly, the flat surfaces of the step portions 23*a* and 23*b* will assist in preventing the boundary layer from being driven toward the impeller, thusly reducing the likelihood of stall, thereby increasing stall margin, and allowing for increased performance of the diffuser 14.

The throat portion 28 according to the present invention represents a significant improvement in the aerodynamic efficiency of the diffuser 14. More specifically, it is conventional to design a compressor considering engine performance, pressure ratio and flow volumes, for example, for determining the required quantity of the plurality of tangentially disposed diffuser passages 22, the required flow area A of the throat portions 28 and the width 2*b* of radially outer tip ends of the impeller blades 16 (see FIG. 5). With the throat flow area A being known, a particular shape or cross section of the throat portion 28 is then determined. In conventional high-performance diffusers, a circular profile of the throat portion 28 is preferred. However, in accordance with the present invention, it has been determined that the throat portion 28 having the quadrilaterial cross section 30, wherein the spacing between the sidewalls 32 and 34 is less than the diameter of an equal area circle, provides for improved aerodynamic performance of the diffuser 14.

More specifically, and referring to FIGS. 1, 4, and 5, the inlet portion 24 of the passages 22 is illustrated and has a length $L_l$. It will be appreciated that the inlet portion 24 receives gases from the impeller 12 at relatively high velocities and relatively low pressures, and is therefore subject to relatively high viscous drag. Accordingly, it has been discovered that any reduction in the length $L_1$ of the inlet portion 24 will decrease the surface area subject to relatively high viscous drag and therefore result in a decrease of the total viscous drag.

Figure 3:
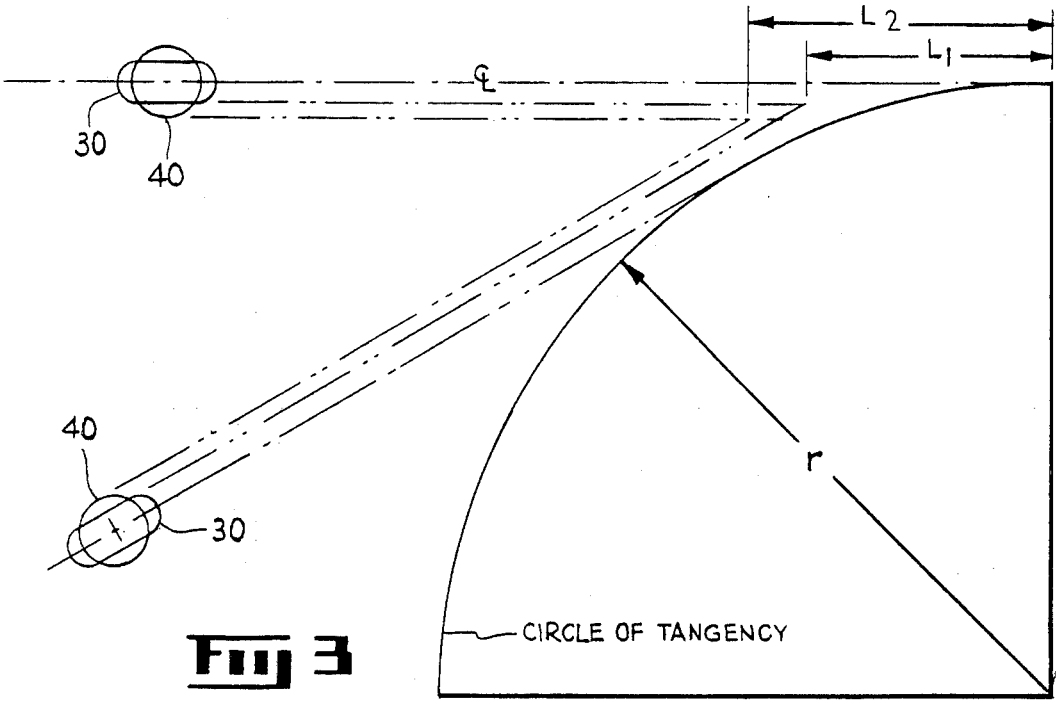
FIG. 3 is a diagrammatic view illustrating and co paring the intersection of a passage having a thr portion in accordance with this invention and a passa of equal area having a circular cross section.

FIG. 3 represents a diagram which illustrates more clearly how the first quadrilateral cross section 30 of the throat portion 28 is effective for obtaining a reduced length $L_1$ of the inlet 24. The circle of tangency of the centerlines of the plurality of passages 22 is shown and has a radius r, which radius r is substantially equal to the radius of the impeller 12. Also illustrated are two adjacent intersecting passages having superimposed cross sections: the first quadrilateral cross section 30 and a reference, circular cross section 40 sharing common tangential centerlines, both of which have a cross-sectional area equal to A.

It will be appreciated that passages having a circular cross section 40 will intersect with each other at a distance $L_2$ measured perpendicularly with respect to the radius r at the point of tangency of the centerline of the top passage. In contrast, passages having the first quadrilateral cross section 30 would intersect with each other at a distance $L_1$, wherein $L_1$ is substantially less than $L_2$. Accordingly, for a given cross-sectional flow area A, a throat portion 28 having the first quadrilateral cross section 30 instead of a circular cross section 40 will result in an inlet portion 24 having a reduced length $L_1$ for reducing viscous drag forces.

The preferred dimensions of the first quadrilateral cross section 30 have been selected for not only reducing the length $L_1$ of the inlet portions 24 but also for retaining part of the circular cross section, which circular sections have proven effective for reducing losses due to flow separation.

It will be appreciated that circular cross sections have been conventionally preferred because for a given cross-sectional area they represent the least wetted surface, i.e. the circumferential length, subject to drag forces. In contrast, a purely rectangular cross section of the same area has a wetted surface, i.e. the perimeter length, which is greater, and, which, therefore, results in greater drag losses. The quadrilateral cross section 30 retains benefits of the circular cross section in the arcuate sidewalls 36 and 38, yet is also effective to reduce the length $L_1$ as above described.

Figure 2:
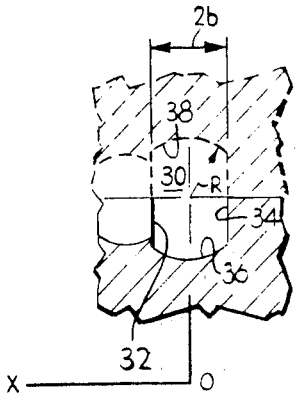
FIG. 2 is a sectional view taken along the line 2—2 FIG. 1.

More specifically, and referring to FIGS. 2 and 5, the linear sidewalls 32 and 34 are spaced from each other a distance 2*b*. The arcuate sidewalls 36 and 38 of the first quadrilateral cross section 30 are defined by a radius R which is determined from the solution of the integral equation:

$$A = 4 \int_0^b \sqrt{R^2 - x^2}\, dx$$

The solution of this integral equation is:

$$A = 2\left[x\sqrt{R^2 - x^2} + R^2 \mathrm{Sin}^{-1}\frac{x}{R}\right]_o^b$$

and applying the bounds of integration results in:

$$A = 2\left(b\sqrt{R^2 - b^2} + R^2\mathrm{Sin}^{-1}\frac{b}{R}\right).$$

The solution of this integral equation is obtained using conventional techniques. In the integral equation, "A" represents the designed-for flow area of the throat portion 28, which is conventionally determined. "x" represents the distance measured outwardly from the center of the first quadrilateral cross section 30 between the two linear sidewalls 32 and 34, and "b" represents one half the spacing between sidewalls 32 and 34.

The distance between the two linear sidewalls 32 and 34 has a value equal to *2b*, which is preferably equal to the tip width of the impeller blades 16, and with the radius R of the two arcuate sidewalls 36 and 38 determined as above described, the first quadrilateral cross section 30 is thereby defined completely.

As illustrated in FIGS. 1 and 4, the throat portion 28, which represents the first fully enclosed portion of the passage 22 which receives gases accelerated by the impeller 12, extends in a tangential direction, a finite length $L_3$. The length $L_3$ is chosen so that as the throat portion 28 erodes from wear, the preferred first quadrilateral cross section 30 is maintained for the designed-for life. Accordingly, the length $L_3$ may be made generally equal to the diameter of a circle having an area equal to the area A of the first quadrilateral cross section 30 of the throat portion 28.

Referring again to FIG. 1, it will be seen that each of the passages 22 further includes a diffuser portion 42 which is integral with the throat portion 28. At a downstream end, the diffuser portion 42 has a second quadrilateral cross section 44 including two substantially parallel opposing linear sidewalls 46 and 48 and two substantially arcuate opposing sidewalls 50 and 52 (see FIG. 6). The diffuser portion 42 has an upstream end integral with the throat portion 28 which includes a third quadrilateral cross section 54 which is substantially identical to the first quadrilateral cross section 30 of the throat portion 28. The diffuser portion 42 is gradually tapered between its upstream and downstream ends.

Figure 6:
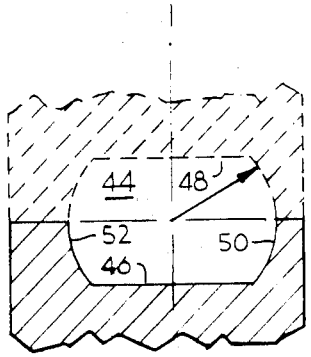
FIG. 6 is a sectional view taken along line 6—6 FIG. 1.

As illustrated in FIGS. 2 and 6, the second quadrilateral cross section 44 of the diffuser section 42 is oriented substantially 90 degrees with respect to the first quadrilateral cross section 30. As illustrated in FIG. 5, the linear sidewalls 32 and 34 of the first quadrilateral cross section 30 of the throat portion 28 are disposed substantially parallel to the tips of impeller blades 16 and substantially normal to a radial axis of the diffuser 14.

The improved diffuser 14 according to this invention lends itself to relatively inexpensive manufacturing techniques which can maintain close tolerances and uniformity between diffusers. Inasmuch as the centerline as well as the walls of the diffuser passages 22 may be linear and make gradual and smooth transitions, the diffuser 14 may be easily manufactured by known electric discharge milling (EDM) techniques.

Figure 7:
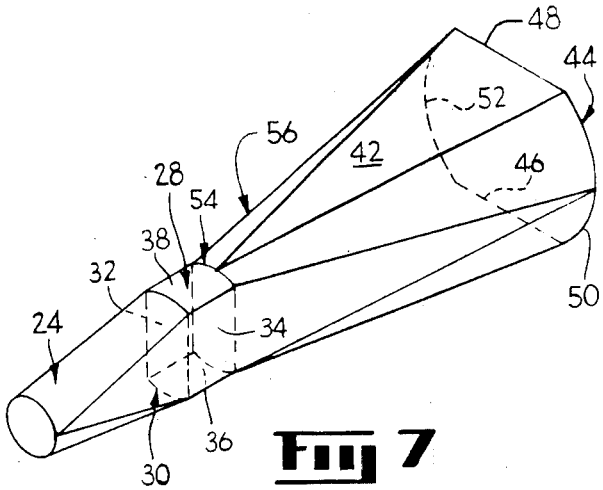
FIG. 7 is a perspective view of an exemplary ED electrode suitable for machining a passage similar to t ones illustrated in FIG. 1.

More specifically, an exemplary EDM electrode 56 suitable for manufacturing passages generally similar to the diffuser passages 22 is illustrated in FIG. 7 and can be very accurately machined firstly on a lathe with appropriate cylindrical, conical and curved sections. Portions of the electrode 56 which create the features of the passages 22 are identified by using the corresponding reference numerals of the passages 22. To easily and accurately obtain the first and second quadrilateral cross sections 30 and 44, the linear sidewalls 32, 34, 44 and 46 may be simply and accurately machined or planed off in a tapered manner for obtaining relatively smooth transitions.

While a preferred embodiment of the present invention has been disclosed, it will be understood that many modifications and changes may be made thereto without departing from the scope of the invention as defined in the intended claims.

Having thus described the invention, what is desired to be secured by Letters Patent of the United States is:

I claim:

1. A diffuser for a centrifugal compressor having an impeller comprising:

an annular housing:

a plurality of passages spaced about the circumference of said housing and extending therethrough, adjacent ones of said passages intersecting with each other at radially inner inlet portions thereof for defining a quasi-vaneless annular inlet of said diffuser, each of said passages further including a throat portion integral with said inlet portion, said throat portion having a first quadrilateral cross section including two substantially parallel linear opposing sidewalls and two substantially arcuate opposing sidewalls, said two linear sidewalls being spaced from each other to define a minor dimension extending therebetween, said two arcuate sidewalls being spaced from each other to define a major dimension therebetween, said major dimension being greater in length than said minor dimension, and said linear sidewalls being disposed substantially normal with respect to a radial axis of said diffuser.

2. A diffuser according to claim 1 wherein said first quadrilateral cross section has an area and said linear opposing sidewalls are spaced from each other a distance less than the diameter of a circle having an area equal to said quadrilateral area.

3. A diffuser according to claim 1 wherein said linear sidewalls are spaced from each other a distance *2b*, each of said arcuate sidewalls of said throat portion is defined by a radius R extending from a center point of said throat portion, said throat portion has a cross sectional area A, and R, A and b are related to each other as follows:

$$A = 2\left(b\sqrt{R^2 - b^2} + R^2\mathrm{Sin}^{-1}\frac{b}{R}\right).$$

4. A diffuser according to claim 3 wherein said distance b represents one half the tip width of blades of said impeller.

5. A diffuser according to claim 1 wherein said throat portion extends with a constant area in a tangential direction for a length generally equal to the diameter of a circle having an area equal to the area of said first quadrilateral cross section of said throat portion.

6. A diffuser according to claim 1 wherein said plurality of passages further includes a diffuser portion integral with said throat portion and having at a downstream end a second quadrilateral cross section including two substantially parallel opposing linear sidewalls and two substantially acruate opposing sidewalls.

7. A diffuser according to claim 6 wherein said diffuser portion further includes at an upstream end a third quadrilateral cross section substantially identical to said first quadrilateral cross section of said throat portion, said diffuser portion being gradually tapered between said upstream and downstream ends.

8. A diffuser according to claim 6 wherein said second quadrilateral cross section is oriented substantially 90 degrees with respect to said first quadrilateral cross section.

9. A diffuser according to claim 1 wherein each of said inlet portions defines a partially bounded passage having a generally semi-circular cross section at an upstream end thereof which is open at opposing base and apex portions thereof, said nlet portion tapering from said semi-circular cross section to said first quadrilateral cross section of said throat portion.

10. A diffuser according to claim 9 wherein said adjacent ones of said inlet portions intersect with each other to define step portions extending and tapering from said throat portion to said upstream end of said inlet portion.

11. A diffuser according to claim 10 wherein said step portions include flat, radially outwardly facing surfaces defined by portions of said linear opposing sidewalls and arcuate, radially inwardly facing surfaces defined by portions of said arcuate opposing sidewalls.

12. In a diffuser of a centrifugal compressor including an impeller, said diffuser including a plurality of tangentially disposed passages each having a throat portion of cross-sectional area A, the improvement comprising:

said throat portion having a quadrilateral cross section defined by two substantially parallel opposing linear sidewalls and two substantially arcuate opposing sidewalls, said two linear sidewalls being spaced from each other to define a minor dimension extending therebetween, said two arcuate sidewalls being sapced from each other to define a major dimension therebetween, said major dimension being greater in length than said minor dimension, and said linear sidewalls being disposed substantially normal with respect to a radial axis of said diffuser.

13. An improved diffuser according to claim 12 wherein said linear sidewalls are spaced from each other a distance 2*b*, each of said arcuate sidewalls is defined by a radius R extending from a center point of said throat portion, and wherein R, A and b are related to each other as follows:

$$A = 2\left(b\sqrt{R^2 - b^2} + R^2\mathrm{Sin}^{-1}\frac{b}{R}\right).$$

14. An improved diffuser according to claim 13 wherein said distance b represents one half the tip width of blades of said impeller.

15. An improved diffuser according to claim 12 wherein said quadrilateral cross sections has an area and said linear opposing sidewalls are spaced from each other a distance less than the diameter of a circle having an area equal to said quadrilateral area.

16. A diffuser according to claim 12 wherein each of said inlet portions defines a partially bounded passage having a generally semi-circular cross section at an upstream end thereof which is open at opposing base and apex portions thereof, said inlet portion tapering from said semi-circular cross section to said first quadrilateral cross section of said throat portion.

17. A diffuser according to claim 16 wherein said adjacent ones of said inlet portions intersect with each other to define step portions extending and tapering from said throat portion to said upstream end of said inlet portion.

18. A diffuser according to claim 17 wherein said step Portions include flat, radially outwardly facing surfaces defined by portions of said linear opposing sidewallls and arcuate, radially inwardly facing surfaces defined by portions of said arcuate opposing sidewalls.

19. A diffuser for a centrifugal compressor having an impeller comprising:

an annular housing;

a plurality of passages spaced about the circumference of said housing and extending therethrough, adjacent ones of said passages intersecting with each other at radially inner inlet portions thereof for defining a quasi-vaneless annular inlet of said difuser, each of said passages further including a throat portion integral with said inlet portion, said throat portion having a first quadrilateral cross section including two substantially parallel linear opposing sidewalls and two substantially arcuate opposing sidewalls, said two linear sidewalls being spaced from each other to define a minor dimension extending therebetween, said two arcuate sidewalls being spaced from each other to define a major dimension therebetween, said major dimension being greater in length than said minor dimension, and said linear sidewalls being disposed substantially normal with respect to a radial axis of said diffuser;

said first quandrilateral cross section having an area and said linear opposing sidewalls being spaced from each other with said minor dimension being less than the diameter of a circle having an area equal to said first quadrilateral area;

each of said inlet portions defining a partially bounded passage having a generally semi-circular cross section at an upstream end thereof which is open at opposing base and apex portions thereof, said inlet portion tapering from said semi-circular cross section to said first quadrilateral cross section of said throat portion;

said adjacent ones of said inlet portions intersecting each other to define step portions extending and tapering from said throat portion to said upstream end of said inlet portion;

said step portions including flat, radially outwardly facing surfaces defined by portions of said linear opposing sidewalls and arcuate, radially inwardly facing surfaces defined by portions of said arcuate opposing sidewalls;

said throat portion extending with a constant area in a tangential direction for a length generally equal to the diameter of a circle having an area to the area of said first quadrilateral cross section of said throat portion;

said plurality of passages further including a diffuser portion integral with said throat portion and having at a downstream end a second quadrilateral cross section including two substantially parallel opposing linear sidewalls and two substantially arcuate opposing sidewalls;

said diffuser portion further including at an upstream end a third quadrilateral cross section substantially identical to said first quadrilateral cross section of said throat portion, said diffuser portion being gradually tapered between said upstream and downstream ends; and said second quadrilateral cross section being oriented substantially 90 degrees with respect to said first quadrilateral cross section.

20. A diffuser according to claim 19 wherein:

said impeller includes blades each having a tip width of 2*b;* said first quadrilateral cross section of said throat portion has an area A;

said linear sidewalls of said first quadrilateral cross section are sapced from each other such that said minor dimension equals 2*b;* said arcuate sidewalls of said first quadrilateral cross section are each defined by a radius R and said major dimension equals 2R; and said area A, said radius R, and said dimension b are related to each other as follows:

$$A = 2\left(b\sqrt{R^2 - b^2} + R^2\mathrm{Sin}^{-1}\frac{b}{R}\right).$$

* * * * *